US006030577A

United States Patent [19]

Commandeur et al.

[11] Patent Number: 6,030,577

[45] Date of Patent: Feb. 29, 2000

[54] PROCESS FOR MANUFACTURING THIN PIPES

[75] Inventors: Bernhard Commandeur, Wülfrath; Rolf Schattevoy, Wuppertal; Klaus Hummert, Coesfeld, all of Germany

[73] Assignee: Erbsloh Aktiengesellschaft, Velbert, Germany

[21] Appl. No.: 09/029,721

[22] PCT Filed: Aug. 28, 1996

[86] PCT No.: PCT/EP96/03779

§ 371 Date: Feb. 27, 1998

§ 102(e) Date: Feb. 27, 1998

[87] PCT Pub. No.: WO97/09458

PCT Pub. Date: Mar. 13, 1997

[30] Foreign Application Priority Data

Sep. 1, 1995 [DE] Germany ..... 195 32 244

[51] Int. Cl.[7] ..... B22F 5/00

[52] U.S. Cl. ..... 419/28; 419/29; 419/41; 419/54; 419/55

[58] Field of Search ..... 419/28, 29, 41, 419/54, 55

[56] References Cited

U.S. PATENT DOCUMENTS

| | | | |
|---|---|---|---|
| 3,325,279 | 6/1967 | Lawrence et al. . | |
| 4,135,922 | 1/1979 | Cebulak | 75/143 |
| 4,155,756 | 5/1979 | Perrot et al. . | |
| 4,537,167 | 8/1985 | Eudier et al. | 123/193 |
| 4,650,644 | 3/1987 | Huret et al. | 419/11 |
| 5,131,356 | 7/1992 | Sick et al. | 123/193.2 |
| 5,648,620 | 7/1997 | Stenzel et al. | 75/232 |
| 5,655,432 | 8/1997 | Wilkosz et al. | 92/71 |
| 5,884,600 | 3/1999 | Wang et al. | 123/193.6 |
| 5,891,273 | 4/1999 | Rückert et al. | 148/523 |

FOREIGN PATENT DOCUMENTS

| | | |
|---|---|---|
| 0366134 | 5/1990 | European Pat. Off. . |
| 0411577 | 2/1991 | European Pat. Off. . |
| 0592665 | 4/1994 | European Pat. Off. . |
| 0635318 | 6/1994 | European Pat. Off. . |
| 0112848 | 5/1986 | France . |
| 0191707 | 9/1988 | France . |
| 810223 | 8/1951 | Germany . |
| 2418389 | 10/1974 | Germany . |
| 2252139 | 9/1976 | Germany . |
| 3435460 | 4/1986 | Germany . |
| 0196145 | 10/1986 | Germany . |
| 4020268 | 8/1991 | Germany . |
| 4111509 | 10/1992 | Germany . |
| 4212716 | 10/1993 | Germany . |
| 4244502 | 3/1994 | Germany . |
| 4230228 | 5/1994 | Germany . |
| 4418750 | 11/1995 | Germany . |
| 19518552 | 11/1995 | Germany . |
| 0704613 | 4/1996 | Germany . |
| 0670441 | 9/1996 | Germany . |
| 4427795 | 4/1997 | Germany . |
| 19610055 | 4/1997 | Germany . |
| 4404420 | 7/1997 | Germany . |
| 19601793 | 7/1997 | Germany . |
| 19605946 | 7/1997 | Germany . |
| 4328093 | 4/1998 | Germany . |
| 63-183140 | 7/1988 | Japan . |
| 63-183141 | 7/1988 | Japan . |
| 0341714 | 1/1989 | Japan . |
| 0100470 | 5/1990 | Japan . |
| 4-66120 | 1/1992 | Japan . |
| 5-29520 | 3/1993 | Japan . |
| 0367229 | 1/1994 | Japan . |
| 0589137 | 3/1994 | Japan . |
| 0363225 | 6/1994 | Japan . |
| 063330263 | 2/1995 | Japan . |
| 672760 | 9/1995 | Japan . |
| 0526079 | 11/1996 | Japan . |
| 0529993 | 1/1997 | Japan . |
| 0600474 | 1/1997 | Japan . |
| 0558957 | 5/1997 | Japan . |
| 0777043 | 6/1997 | Japan . |
| 0577436 | 12/1997 | Japan . |
| 0669404 | 6/1998 | Japan . |
| 0518815 | 12/1992 | Switzerland . |
| 665223 | 4/1998 | Switzerland . |
| 746633 | 12/1994 | United Kingdom . |
| 0710729 | 5/1996 | United Kingdom . |
| 788413 | 2/1997 | United Kingdom . |

OTHER PUBLICATIONS

Chemical Abstract vol. 98 #20, May 16, 1983 Columbus Ohio Abstract #165644, Japan "Abrasion–Resistant Aluminum . . . ".

"Aluminum im Automobilbau" "Stand, Anwendung und Perpektive am Beispiel von Technologien für Zylinderlaufflächen im Motorblock" by E. Köler, KS Aluminum–Technologie AG, Germany, published in Galvanotechnik D–88348 Saulgau 85 (1994) Nr.9, pp. 2885–2893.

Legierungen aut AL–Si–Basis–Bandbreite Möglichkeiten, Grenzen by G. Huppert, L. Kahlen, J. Spielfield, Metall 49, Jahrgang Nr 3/95.

"Feinung der Si–Primärphase ubereutektischer ALSi–Gusslegierungen" by W. Schneider, W. Reif, A. Banerji, published in Forschung.

*Primary Examiner*—Daniel J. Jenkins
*Attorney, Agent, or Firm*—Horst M. Kasper

[57] ABSTRACT

The invention relates to a method for manufacturing thin-walled pipes, which are made of a heat-resistant and wear-resistant aluminum-based material. The method comprises the providing of a billet or a tube blank made of a hypereutectic aluminum-silicon AlSi material, possibly a subsequent averaging annealing, the extruding of the billet or of the tube blank to a thick-walled pipe, and the hot deformation of this pipe to a thin-walled pipe. Such a method is in particular suited for the production of cylinder liners of internal combustion engines, since the produced liners exhibit the required properties in regard to wear resistance, heat resistance and reduction of pollutant emission.

22 Claims, 2 Drawing Sheets

AlSi25Cu2,5Mg1Ni1 ; as spraycompacted 20 µm

AlSi25Cu2,5Mg1Ni1 ; annealed, extruded 20 µm

AlSi8Fe3Ni2 +20% Si particles ; as spraycompacted 100 µm

AlSi8Fe3Ni2 +20% Si particles ; as extruded 100 µm

PROCESS FOR MANUFACTURING THIN PIPES

BACKGROUND OF THE INVENTION

The invention relates to a method for manufacturing thin-walled pipes, which pipes are made of a heat-resistant and wear-resistant aluminum-based material, in particular for use as cylinder liners for internal combustion engines.

Cylinder liners are components subject to wear, which are inserted, pressed or cast into the cylinder openings of the crankcase of the internal combustion engine.

The cylinder faces of an internal combustion engine are subjected to high frictional loads from the pistons or, respectively, from the piston rings and to locally occurring high temperatures. It is therefore necessary that these faces be made of wear-resistant and heat-resistant materials.

In order to achieve this goal, there are numerous processes amongst others to provide the face of the cylinder bore with wear-resistant coatings. Another possibility is to dispose a cylinder liner made of a wear-resistant material in the cylinder. Thus, gray-cast-iron cylinder liners were used, amongst others, which liners however exhibit a low heat conductivity as compared to aluminum-based materials and exhibit other disadvantages.

The problem was first solved with a cast cylinder block made of a hypereutectic aluminum-silicon AlSi alloy. The silicon content is limited to a maximum of 20 weight-percent for reasons associated with casting technology. As a further disadvantage of the casting method it is to be mentioned that primary silicon particles of relatively large dimensions (about 30–80 $\mu$m) are precipitated during the solidification of the melt. Based on the size and their angular and sharp-edged form, the primary silicon Si particles lead to wear at the piston and piston rings. One is therefore forced to protect the pistons and the piston rings with corresponding protective layers/coatings. The contact face of the silicon Si particles to the piston/piston ring is flat-smoothed through mechanical machining treatment. An electrochemical treatment then follows to such a mechanical treatment, whereby the aluminum matrix is slightly reset between the silicon Si grains such that the silicon Si grains protrude insignificantly as support structure from the cylinder face. The disadvantage of thus manufactured cylinder barrels lies, on the one hand, in a substantial manufacturing expenditure (costly alloy, expensive mechanical machining treatment, iron-coated pistons, armored and reinforced piston rings) and, on the other hand, in the defective distribution of the primary silicon Si particles. Thus, there are large areas in the microstructure which are free of silicon Si particles and thus are subject to an increased wear. In order to prevent this wear, a relatively thick oil film is required as separation medium between barrel and friction partner. The clearing depth of the silicon Si particles is amongst others decisive for the setting of the oil-film thickness. A relatively thick oil film leads to higher friction losses in the machine and to a larger increase of the pollutant emission.

In comparison, a cylinder block according to the DE 42 30 228, which is cast of an below-eutectic aluminum-silicon AlSi alloy and is provided with liners of a hypereutectic aluminum-silicon AlSi alloy material is more cost advantageous. However, the aforementioned problems are also not solved in this case.

In order to employ the advantages of the hypereutectic aluminum-silicon AlSi alloys as a liner material, the microstructure in regard to the silicon grains is to be changed. As is known, aluminum alloys, which cannot be realized using casting technology, can be custom-produced by powder-metallurgic processes or spray compacting.

Thus, in this way hypereutectic aluminum silicon AlSi alloys are produceable which have a very good wear resistance and receive the required heat resistance through alloying elements such, as for example iron Fe, nickel Ni, or manganese Mn, based on the high silicon content, the fineness of the silicon particles, and the homogeneous distribution. The primary silicon particles present in these alloys have a size of about 0.5 to 20 $\mu$m. Therefore, the alloys produced in this way are suited for a liner material.

Even though aluminum alloys are in general easy to be processed, the deformation of these hypereutectic alloys is more problematic. A method for producing liners from a hypereutectic aluminum-silicon alloy is known from the German printed patent document EP 0 635 318. According to this reference the liner is produced by extrusion presses at very high pressures and extrusion rates of from 0.5 to 12 m/min. Very high extrusion rates are required in order to produce the liners to a final dimension with extruders cost-effectively. It has been shown that the high extrusion rates lead to a tearing of the profile during extrusion in case of such difficultly extrudable alloys and of the small wall thicknesses of the liners to be achieved.

SUMMARY OF THE INVENTION

The object of the invention is to provide for an improved, cost-advantageous method for manufacturing thin-walled pipes, in particular for cylinder liners of internal combustion engines, wherein the finished liners are to exhibit the required property improvements in regard to wear resistance, heat resistance, and reduction of the pollutant emission.

According to the invention, the object is solved by a method with the method steps recited in patent claim 1.

Additional embodiments of the invention are given in the sub-claims.

DESCRIPTION OF THE INVENTION

Figure 1:
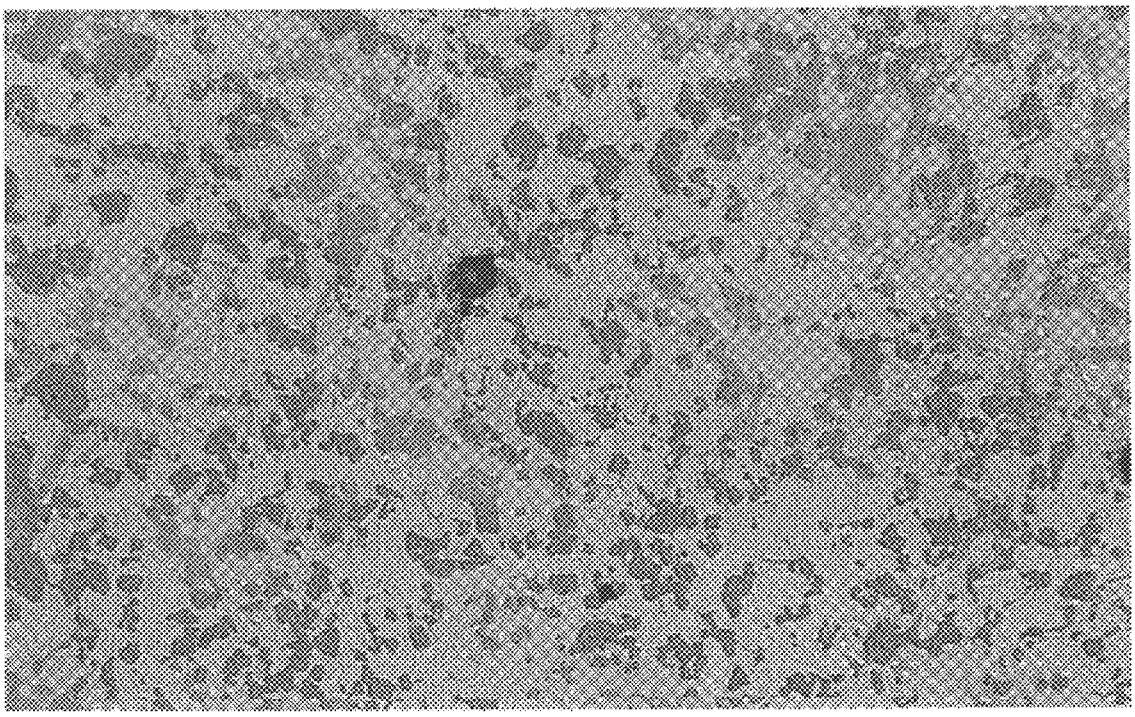
FIG. 1 shows the microstructure of a spray compacted billet.

The required tribological properties are in particular achieved in that silicon particles are present in the material as primary precipitates in a size range of from 0.5 to 20 $\mu$m, or as admixed particles in a size range of up to 80 $\mu$m. Methods have to be employed for the manufacture of such aluminum Al alloys which allow a substantially higher solidification rate of a high-alloy melt than it is possible with conventional casting processes.

On the one hand, the spray compacting method (in the following referred to as "spray compacting") belongs to this. An aluminum alloy melt, highly alloyed with silicon, is atomized and cooled in the nitrogen stream at a cooling rate of 1000° C. The in part still liquid powder particles are sprayed onto a rotating disk. The disk is continuously moved downwardly during the process. A cylindrical billet is generated by the superposition of the two motions, wherein the billet has dimensions of from approximately 1000 to 3000 in length at a diameter of up to 400 mm. Primary silicon Si precipitates up to a size of 20 $\mu$m are generated in this spray compacting process based on the high cooling rate. An adaptation of the silicon Si precipitate size is achieved with the "gas to metal ratio" (standard cubic meter of gas per kilogram of melt), with which the solidification speed can be set in the process. Silicon contents of the alloys up to 40 weight-percent can be achieved based on the solidification rates and the supersaturation of the melt. The supersaturation state in the resulting billet is quasi "frozen" based on the fast quenching of the aluminum melt in the gas stream.

Alternatively to the billet manufacture, also thick-walled tube blanks having inner diameters of from 50–120 mm and a wall thickness up to 250 mm can be manufactured with the spray compacting. For this purpose, the particle stream is directed after the atomization onto a support pipe rotating horizontally around its longitudinal axis, and is compacted there. Based on a continuous and controlled advance in horizontal direction, a tube blank is produced in this way, which tube blank serves as stock blank for the further processing by tube extrusion presses and/or other hot-deformation processes. The aforementioned support pipe is made of a conventional aluminum wrought alloy or of the same alloy, as it is manufactured by the spray compacting (of the same kind).

The spray compacting process in addition offers the possibility to enter particles with a particle injector into the billets or into the tube blanks, which particles were not present in the melt. There exists a plurality of adjustment possibilities for a microstructure since these particles can exhibit any desired geometry and any desired size between 2 $\mu$m and 400 $\mu$m. These particles can be, for example, silicon Si particles in the range of from 2 $\mu$m to 400 $\mu$m or oxide-ceramic particles (for example, $Al_2O_3$) or non-oxide-ceramic particles (for example, SiC, $B_4C$, etc.) in the aforementioned particle-size spectrum, as they are commercially available and sensible for the tribological aspect.

A further possibility to produce a suitable microstructure formation lies in the fast solidification of an aluminum alloy melt, supersaturated with silicon (in the following "powder route"). For this purpose, a powder is produced by means of an air atomization or inert-gas atomization of the melt. This powder can on the one hand be completely alloyed, which means that all alloy elements were contained in the melt, or the powder is mixed from several alloy powders or element powders in a subsequent step. The completely alloyed powder or the mixed powder is subsequently pressed by cold-isostatic pressing or hot pressing or vacuum hot-pressing to a billet or a thick-walled hollow cylinder (tube blank).

The microstructural condition of the spray-compacted billets/tube blanks or of the billets/tube blanks which were manufactured via the powder route can be changed with subsequent averaging annealing processes. The microstructure can be set with an annealing to a silicon grain size of from 2 to 30 $\mu$m as it is desired for the required tribological properties. The growing of larger silicon Si particles during the annealing process is effected by diffusion in the solid at the expense of smaller silicon particles. This diffusion is dependent on the overaging and annealing temperature and the duration of the annealing treatment. The higher the temperature is chosen, the faster the silicon Si grains grow. Desired temperatures are at about 500° C., wherein an annealing time period of 3 to 5 hours is sufficient.

The thereby resulting and therefore custom-made microstructure no longer changes in the subsequent processing steps or it changes favorably for the required tribological properties.

A thick-walled pipe with a wall thickness of from 6 to 20 mm is formed from the billet blank, where the billet blank was manufactured by "spray compacting" or by the "powder route", by hot deformation, preferably by extrusion. For this purpose, the extrusion temperatures are between 300° C. and 550° C.

The extruding not only serves to form, but also to close the residual porosity of the spray-compacted billets or of the spray-compacted tube blanks (1–5%) or, respectively, of the billets or of the tube blanks which were manufactured via the "powder route" (1–40%), and to completely and finally consolidate the material.

The additional, still necessary reduction in wall thickness is achieved by swaging or another hot-deformation process at temperatures of from 250° C. to 500° C.

The pipe, formed to the final wall thickness, is subsequently cut into pipe sections of the required length.

The invention method has the advantage that the material for the liner can be custom-made. The high expenditure in the case of extruding, both in regard to extrusion pressure, extrusion rate, as well as product quality, is avoided based on the subsequent second hot-deformation process step.

EXAMPLE 1

Figure 2:
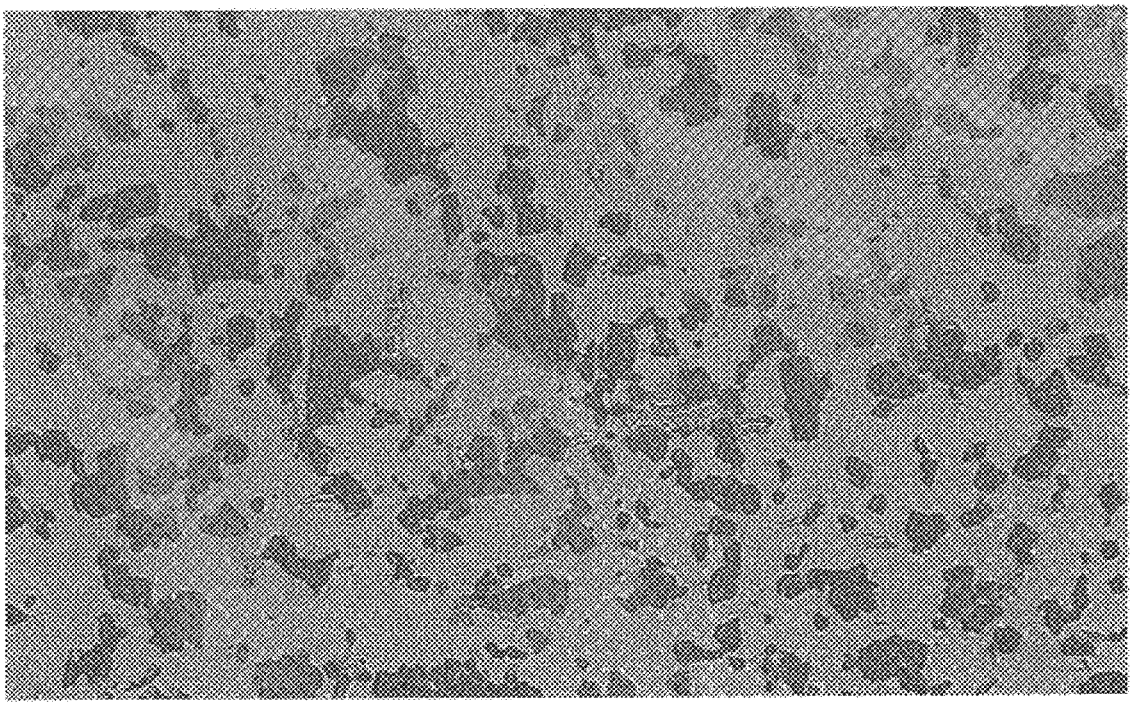
FIG. 2 shows the microstructure of a pipe formed by annealing and hot extrusion.

An alloy of the composition $Al_1Si_{25}Cu_{2.5}Mg_1Ni_1$ is compacted to a billet according to the spray compacting process at a melt temperature of 830° C. with a gas/metal ratio of 4.5 $m^3$/kg (standard cubic meter gas per kilogram of melt). The silicon Si precipitates in the size range of from 1 $\mu$m to 10 $\mu$m (microstructure FIG. 1) are present under the recited conditions in the spray-compacted billet. The spray-compacted billet is subjected to an annealing treatment of four hours at 520° C. The silicon Si precipitates are in the size range of from 2 $\mu$m to 30 $\mu$m after this annealing treatment. A pipe with an outer diameter of 94 mm and an inner diameter of 69.5 mm (microstructure FIG. 2) is produced in a porthole die by hot extruding at 420° C. and a profile exit rate of 0.5 m/min. The subsequent hot deformation by round kneading and swaging at 420° C. from an outer diameter of 94 mm to an outer diameter of 79 mm and an inner diameter of 69 mm, which is formed by a mandrel, does not lead to a change in microstructure.

EXAMPLE 2

Figure 3:
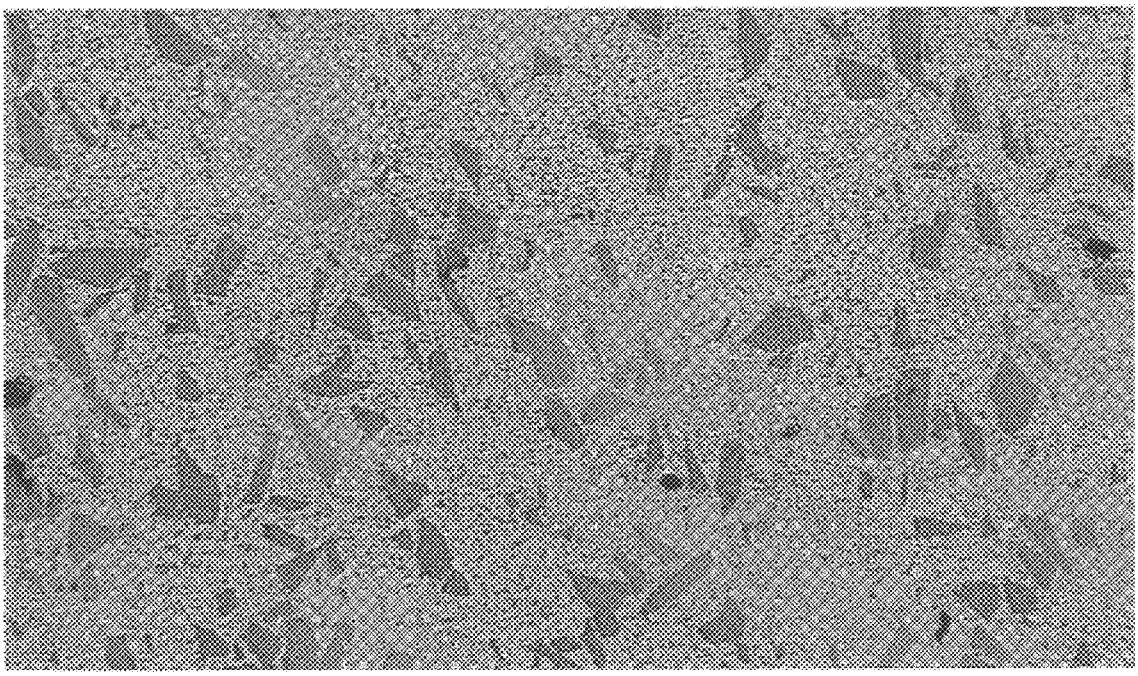
FIG. 3 shows the microstructure of a spray compacted billet.
Figure 4:
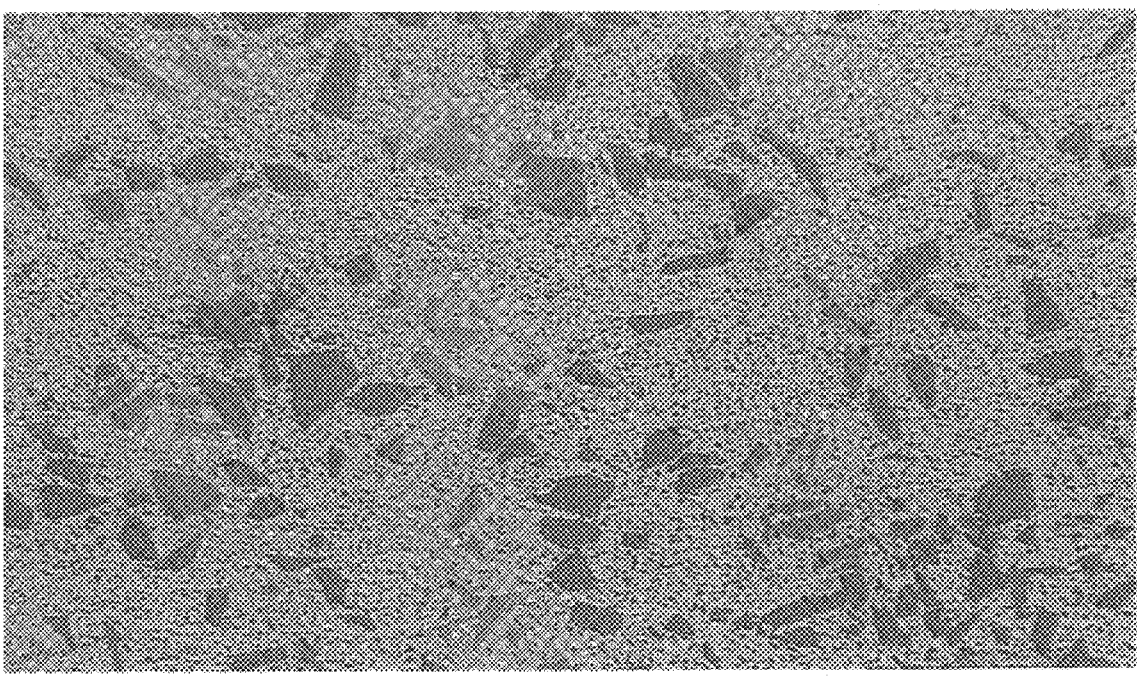
FIG. 4 shows the microstructure of a pipe formed by hot extusion.

An alloy of the composition $Al_1Si_8Fe_3Ni_2$ is compacted at a melt temperature of 850° C. of the hot metal with a gas/metal ratio of 2.0 $m^3$/kg after the spray compacting process to a billet. 20% Si particles in the size range of from 40 $\mu$m to 71 $\mu$m are added to this alloy with the particle injector. A homogeneous microstructure can be produced based on the process (microstructure FIG. 3). Since the desired microstructure resulted with the spray-compacting process, an annealing treatment is not required. A pipe having an outer diameter of 94 mm and an inner diameter of 69.5 mm (microstructure FIG. 4) resulted from the hot extrusion at 450° C. and a profile discharge speed of 0.3 m/min in a porthole die. The subsequent hot deformation by round kneading and swaging at 440° C. from an outer diameter of 94 mm to an outer diameter of 79 mm does not lead to a change in microstructure.

EXAMPLE 3

An alloy of the composition $Al_1Si_{25}Cu_{2.5}Mg_1Ni_1$ is atomized with air at a melt temperature of 830° C. of the hot metal. The resulting powder is collected and cold-pressed isostatically at 2700 bar to a billet having an outer diameter of 250 mm and a length of 350 mm. The density of the billet amounts to 80% of the theoretical density of the alloy. The primary silicon Si precipitates are in the range of from 1 μm to 10 μm. The isostatically cold-pressed billets are subjected to an annealing treatment of four hours at 520° C. After this annealing treatment, the silicon Si precipitates are in the size range of from 2 μm to 30 μm. The material is completely compacted and formed to a pipe having an outer diameter of 94 mm and an inner diameter of 69.5 mm based on the hot extrusion at 420° C. and a profile discharge speed of 0.5 m/min in a porthole die. The subsequent hot deformation by round kneading and swaging at 420° C. from an outer diameter of 94 mm to an outer diameter of 79 mm and an inner diameter of 69 mm, which is formed by a mandrel, does not lead to a change in microstructure.

EXAMPLE 4

An alloy of the composition $Al_1Si_{25}Cu_{2.5}Mg_1Mi_1$ is compacted at a melt temperature of 850° C. of the hot metal with a gas/metal ratio of 2.5 $m^3$/kg according to the spray-contacting method to a tube blank having an outer diameter of 250 mm and an inner diameter of 80 mm. For this purpose, a thin-walled pipe, having an outer diameter of 84 mm and having a wall thickness of 2 mm and made of a conventional aluminum wrought alloy ($AlMgSi_{0.5}$), serves as rotating support pipe onto which the above recited alloy is sprayed. The silicon precipitates are in the size range of from 0.5 μm to 7 μm in the spray-compacted tube blank under the recited conditions. In order to set the silicon precipitates to a size of from 2 to 30 μm, the spray-compacted tube blank is subjected to an annealing treatment of 5 hours at 520° C. A pipe having an outer diameter of 94 mm and an inner diameter of 69.5 mm results by tube extrusion at 400° C. and a profile discharge speed of 1.5 m/min. In this case, the pipe support material $AlMgSi_{0.5}$ in particular has a positive effect on the required extrusion force and speeds since it acts as lubricant in the direction of and parallel to the mandrel. The subsequent hot deformation by round kneading and swaging at 430° C. from an outer diameter of 94 mm to an outer diameter of 79 mm and an inner diameter of 69 mm, which is formed by a mandrel, does not lead to a change in microstructure.

We claim:

1. A method for manufacturing liners for internal combustion engines made of a hypereutectic aluminum silicon AlSi alloy comprising the steps of spray compacting an Al alloy melt to obtain starting structures, wherein the contained primary silicon Si particles have a size of from 0.5 to 20 μm; maintaining the starting structures at an extrusion temperature of from about 300 to 550° C.; extruding the starting structures to thick-walled pipes having a wall thickness of from 6 t 20 mm; and reducing the wall thickness of the thick-walled pipes by a hot-deformation process at temperatures of from 250 to 500° C. from 1.5 to 5 mm.

2. The method according to claim 1, wherein the starting structures are billets.

3. The method according to claim 1, wherein the starting structures are tube blanks.

4. The method according to claim 1, wherein the contained primary silicon Si particles have a size of from 1 to 10 μm.

5. The method according to claim 1, further comprising annealing said starting structures in case of need for coarsening the contained primary silicon Si particles to overage them for growing the primary silicon Si particles to a size of from about 2 to 30 μm.

6. The method according to claim 1, wherein the Al alloy melt employed for manufacturing the starting structures has about the following composition:

AlSi(17–35)Cu(2.5–3.5)Mg(0.2–2.0)Ni(0.5–2).

7. The method according to claim 1, wherein the alloy melt employed for manufacturing the starting structures has about the following composition:

AlSi(17–35)Fe(3–5)Ni(1–2).

8. Method according to claim 1, wherein the Al alloy melt employed for manufacturing the starting structures has about the following composition:

AlSi(25–35).

9. The method according to claim 1, wherein the Al alloy melt employed for manufacturing the starting structures has about the following composition:

AlSi(17–35)Cu(2.5–3.3)Mg(0.2–2,0)Mn(0.5–5).

10. The method according to claim 1, further comprising wherein spray compacting the Al alloy melt further comprises;

furnishing a part of the silicon Si from a melt of an aluminum-silicon AlSi alloy employed for that purpose into the starting structure; and furnishing a part of the silicon in the form of silicon Si powder by means of a particle injector into the starting structure during spray compacting.

11. The method according to claim 1, further comprising annealing said starting structures at temperatures of from about 460 to 540° C. over a time period of from about 0.5 to 10 hours in case of need for coarsening the contained primary silicon Si particles to overage them for growing the primary silicon Si particles to a size of from about 2 to 30 μm.

12. The method according to claim 1, further comprising performing the hot-deformation process of the thick-walled pipes by round kneading and swaging or rotary swaging.

13. The method according to claim 1, further comprising performing the hot-deformation process of the thick-walled pipes by tube rolling with an internal tool.

14. The method according to claim 1, further comprising performing the hot-deformation process of the thick-walled pipes by press rolling.

15. The method according to claim 1, further comprising the hot-deformation process of the thick-walled pipes by tube drawing.

16. The method according to claim 1, further comprising performing the hot-deformation process of the thick-walled pipes by annular rolling.

17. The method according to claim 1, further comprising cutting the pipes into pipe sections of a desired length after having been formed in diameter and in wall thickness to a final dimension.

18. A method for manufacturing liners for internal combustion engines made of a hypereutectic AlSi alloy comprising the steps of compacting metallic powder obtained by atomization in a particle size of less than about 250 μm, wherein contained primary silicon Si particles have a size of from about 0.5 to 20 μm to obtain starting structures;

maintaining the starting structures at an extrusion temperature of from about 300 to 550° C.;

extruding the starting structures to thick-walled pipes having a wall thickness of from 6 to 20 mm; and reducing the wall thickness of the thick-walled pipes by a hot-deformation process at temperatures of from 250 to 500° C. from 1.5 to 5 mm.

19. The method according to claim 18, further comprising compacting the metallic powder by hot compacting.

20. The method according to claim 18, further comprising compacting the metallic powder by cold compacting.

21. The method according to claim 18, wherein the metallic powder is a member selected from the group consisting of metal powder, alloy powder, and mixtures thereof obtained by atomization in a presence of a member selected from the group consisting of inert gas, air, and mixtures thereof.

22. Method for manufacturing liners for internal combustion engines made of a hypereutectic aluminum silicon AlSi alloy, characterized in that billets or tube blanks are provided by spray compacting an alloy melt or by hot compacting and cold compacting, respectively, a mixture of metal powder or alloy powder, obtained by air atomization or inert-gas atomization, respectively, in a particle size of smaller than 250 $\mu$m, wherein the contained primary silicon Si particles have a size of from 0.5 to 20 $\mu$m, and preferably a size of from 1 to 10 $\mu$m, said billets or tube blanks are subjected to an overaging annealing, wherein the primary silicon Si particles grow to a size of 2 to 30 $\mu$m, the billets or tube blanks, kept at an extrusion temperature of from 300 to 550° C., are extruded to thick-walled pipes having a wall thickness of from 6 to 20 mm, and the wall thickness of the thick-walled pipes is reduced by a hot-deformation process at temperatures of from 250 to 500° C. from 1.5 to 5 mm.

* * * * *